United States Patent [19]

Iwasa et al.

[11] 4,075,011

[45] Feb. 21, 1978

[54] ELECTROSTATIC POWDER COATING METHOD

[75] Inventors: Masakazu Iwasa, Tokyo; Kazuo Horikawa, Asaka; Seiji Matsumoto, Asaka, all of Japan

[73] Assignee: Fuji Photo Film Co., Ltd., Minami-ashigara, Japan

[21] Appl. No.: 532,226

[22] Filed: Dec. 12, 1974

[30] Foreign Application Priority Data

Dec. 12, 1973 Japan ..... 48-139865

[51] Int. Cl.[2] ..... G03G 13/22

[52] U.S. Cl. ..... 96/1 R; 96/1.4; 118/7; 118/8; 118/644; 355/3 R; 355/3 DD; 356/162; 356/205; 427/14

[58] Field of Search ..... 96/1 R, 1.4; 355/3 DD, 355/3 R; 427/18, DIG. 11, 14; 356/162, 205; 118/7, 8, 644; 178/6.6 R

[56] References Cited

U.S. PATENT DOCUMENTS

| | | | |
|---|---|---|---|
| 3,833,365 | 9/1974 | Hiwano et al. | 96/1 R |
| 3,926,627 | 12/1975 | Iwasa | 96/1 R |
| 3,926,628 | 12/1975 | Honjo | 96/1 R |

FOREIGN PATENT DOCUMENTS

| | | | |
|---|---|---|---|
| 990,538 | 4/1965 | United Kingdom | 96/1 R |

*Primary Examiner*—Thomas J. Herbert, Jr.
*Attorney, Agent, or Firm*—Fleit & Jacobson

[57] ABSTRACT

In an electrostatic powder coating method for coating a plate with electrostatic coating powder after or before the plate is provided with marking lines by electrophotographic print marking process, areas which are preferred to be free from the coating are not applied with the coating powder. After the coating powder is uniformly scattered on the plate, the powder is selectively removed to form a pattern shaped coating on the plate to form a non-coat area around the marking lines. In order to selectively remove the powder from the surface of the plate, a powder removing device which is controlled by a non-coating signal is used. The non-coating signal is given by a non-coating information output device. The non-coating information is recorded on an original which carries marking information for the electrophotographic print marking process. The marking information is recorded in one color and the non-coating information is recorded in another color on the original so that the marking information and the non-coating information may be detected independently of each other.

11 Claims, 13 Drawing Figures

ELECTROSTATIC POWDER COATING METHOD

BACKGROUND OF THE INVENTION

1. Field of the Invention

This invention relates to an electrostatic powder coating method, and more particularly to a method of selectively coating a plate with electrostatic powder so that the parts thereof on which the coating is not necessary or the coating is undesirable are not applied with coating.

2. Description of the Prior Art

The electrostatic powder coating method is well known in the art and has various advantages over the conventional coating method by use of solvent type coating material. In the electrostatic powder coating method, the charged powders employed are electrostatically attracted by the charged plate and fixed thereto by fusing. Since no solvent is used, there is no problem of pollution and it is possible and easy to apply a thick coating on the plate. Further, the characteristics of the coating are superior to those of the solvent coating process.

On the other hand, it is well known to provide marking lines on a plate by an electrophotographic method in the field of shipbuilding, building construction, civil engineering etc. As is well disclosed in Japanese patent publication No. 12385/1969, the electrophotographic marking method is a process to record marking lines on a plate by modulating the electrostatic attractive force between the plate and the photoconductive powder applied thereon in accordance with pattern information based on an optical original.

In general, the plate or member on which the marking lines are provided is cut or welded along the marking lines. The marked area of the plate should be free from a coating material since the coating material hinders cutting and welding of the plate. In welding, since the plate to be processed is heated up to a high temperature, the coating material is burnt or vaporized and blowholes or pits are made in the bead weld and the welding strength is lowered thereby. Therefore, the part of the plate to be welded is best be free of coating material. After uniform application of the coating material, the coating material is desirably removed from the surface of the plate. Also in cutting, the coating material existing on the plate along the cutting line hinders smooth cutting of the plate at high speed. Further, the material coating the plate is damaged by heat when the plate is cut, and accordingly, the plate must be coated with the coating material again after the cutting.

The area in which the coating is not necessary or undesirable is often quite large. Therefore, if it should be made possible to apply the coating material only in the range where the coating is necessary, there would be a considerable saving of labor and lowering of the cost of the coating process.

In the conventional coating process using a solvent type coating agent, it has been known to apply the coating material in a pattern-like area on a plate by spraying the coating material on the plate with a masking member placed thereon to selectively cover the plate in a pattern-like form. However, this type of selective coating is very difficult to accomplish in the electrostatic powder coating process. This is because the powder which is electrostatically applied on the plate to be coated is not fixed to the plate until it is fused by heat, and accordingly, the powder is likely to fall on the plate in the region where no coating is desired when the masking member is removed from the plate with the powder applied thereon. The powder which falls on the plate in the area where no coating is desired is also fixed to the plate when the plate is heated to fuse and fix the powder thereon. If the powder is heated for fixing without removing the masking member, the powder on the masking member is also fused and fixed to the member and there results a great loss of costly coating powder. Further, in case that the masking member is of large size, it is difficult to remove the masking member from the plate without scratching or damaging the surface of the plate.

Further, it has also been known in the art to apply the coating material in a pattern-like area on a plate by controlling the operation of the spray gun for spraying the electrostatic powder on a plate. This is, however, very impractical and difficult, since the charged coating powder moves along electric lines of force between the spray gun and the surface of the plate which radially extend therebetween. The charged powder, therefore, is distributed widely over the plate and the thickness of the coating material on the plate is not uniform.

Another example of a method of selectively applying a coating material in a pattern-like area on a plate is to utilize an electrophotographic method. As shown in Japanese patent publication No. 22645/1963 and British Pat. No. 990538, photoconductive powder can be selectively removed from the surface of a plate after it is uniformly applied thereon by exposing the plate with the photoconductive powder to imagewise light. By the imagewise exposure, the photoconductive powder which has been charged and fixed to the surface of the plate by electrostatic force is released therefrom. After the photoconductive powder is selectively removed, electrostatic coating powder which is charged in the same polarity as that of the photoconductive powder is scattered on the plate so that the latter may fall on the plate only in the area where the photoconductive powder does not exist. Then the coating powder is fused and fixed to the plate and the photoconductive powder is removed from the plate after uniform exposure of the plate to light. Thus, a pattern-like coating can be obtained on a plate.

The above described method of forming a pattern-like coating on a plate by use of photoconductive powder suffers from a defect that the coating powder mingles into the photoconductive powder which is recovered. The properties of the photoconductive powder are degraded by the coating powder mingled therewith. Therefore, in the method of using the photoconductive powder, the coating powder must be separated from the recovered photoconductive powder.

It is difficult to perform the separation with high efficiency and obtain photoconductive powder of high purity. The whole process becomes complicated owing to this separation step and the cost of the coating process is consequently not lowered. The main reason for the difficulty in separation is that the photoconductive powder and the coating powder aggregate together by friction charging. Since the coating powder is charged in advance, the static aggregation force is quite large. Besides, since the particles of the photoconductive powder and the coating powder are very small in size, i.e. 20 to 150 microns in diameter, and the two kinds of powder are very similar in appearance, the separation of the two is very difficult in mechanical sense.

The foregoing method of forming a pattern-like coating on a plate by use of photoconductive powder is further disadvantageous in that the properties of the coating powder are degraded by the mingling of the photoconductive powder into the coating powder which occurs when the photoconductive powder is removed from the surface of the plate. Further, the properties of the coating powder are degraded by the fog formed in the background of the pattern when the photoconductive powder image is formed on the plate. This method of forming a pattern-like coating on a plate is further disadvantageous in that the thickness of the coating obtained by one coating process is limited by the surface potential of the photoconductive powder layer formed on the plate prior to the coating step. This is because the coating powder will stick on the photoconductive powder layer also if the surface potential of the coating powder becomes higher than that of the photoconductive powder.

SUMMARY OF THE INVENTION

The inventors of the present invention found that a pattern-like coating can be obtained by selectively removing the coating powder from the surface of a plate after the coating powder is uniformly distributed over the plate and fixed to the surface thereof by an electrostatic attractive force. The best way to remove the coating powder was found to be by air blow or air suction. The coating powder can be first charged and then applied to the plate or first applied to the plate and then charged.

The removal of the coating powder is performed automatically by use of a controlling means which is responsive to a control signal providing means. The signal providing means employs the original pattern such form as the transparency used in the electrophotographic print marking process. The optical original carries information on the areas not to be coated (hereafter called "no coat areas") in addition to information on the marking lines to be recorded on the plate. The control signal providing means takes information on the no coat areas and supplies a signal to control said controlling means to control the operation of the powder removing means.

In view of the foregoing observations and description of the conventional electrostatic powder coating process, the primary object of the present invention is to provide an electrostatic powder coating method in which the coating powder is applied only to the areas wherein the coating is necessary.

Another object of the present invention is to provide an electrostatic powder coating method in which the areas where the coating is undesirable or unnecessary are prevented from being coated with the coating powder by use of a control means which is controlled by a single control system of simple construction.

Still another object of the present invention is to provide an electrostatic powder coating method in which the surface to be applied with the coating powder is selectively coated in a pattern form by use of a simple control system of low cost.

A further object of the present invention is to provide an electrostatic powder coating method in which both surfaces of a plate can be selectively coated in a pattern form.

A still further object of the present invention is to provide an electrostatic powder coating method which is particularly suitable for selectively coating a plate on which marking lines are recorded by an electrophotographic print marking process.

In accordance with the method of the present invention, an optical original which carries information for print marking and for selective coating of the plate with coating powder is used for both printing marking lines on a plate and selectively coating the plate in a pattern form. Since only one original is used for both printing and coating, the control system can be simplified in construction and lowered in cost.

Other objects, features and advantages of the present invention will be apparent from the following detailed description of the preferred embodiments thereof taken in conjunction with the accompanying drawings.

PREFERRED EMBODIMENTS OF THE INVENTION

Figure 1:
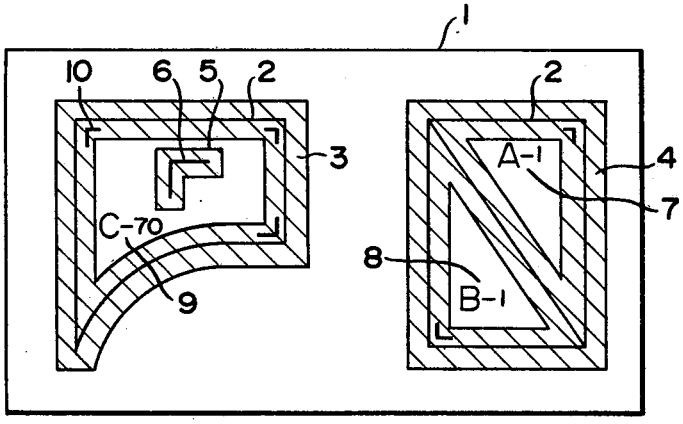
FIG. 1 is a plan view showing an example of an optical original which carries the print marking information and the coating information used in the method in accordance with the present invention.

Now referring to FIG. 1, an example of an optical original which carries information on the print marking and coating will be described. The optical original 1 is made of a material formed in a sheet which is transparent to a part or the whole of visible light or at least a part of ultra violet light or near infra-red light. The optical original 1 carries marking lines 2 and 6 which indicate cutting lines, welding lines and so forth, character information 7, 8 and 9, and mark information 10. The optical original 1 further carries non-coating information 3, 4 and 5 indicated by hatching in the vicinity of the lines. The marking lines 2 and 6, the character information 7, 8 and 9, and the mark information 10 will be hereinafter referred to simply as "marking information". The non-coating information 3, 4 and 5 indicates the areas in which no coating is desired. The non-coating information is indicated with a color different from that which indicates the marking information so that the two kinds of information will transmit different color of light.

In performing the electrophotographic print marking and the electrostatic powder coating using the optical original as described above, there are two methods as follows. One is to first perform the electrophotographic print marking in accordance with the method as disclosed in Japanese patent application No. 68481/1973 and then apply a pattern-like coating of the electrostatic powder, and the other is to first apply the powder coating and then perform the electrophotographic print marking in accordance with the method as disclosed in Japanese patent application Nos. 46400/1973, 50428/1973 and 115370/1972.

The former method will hereinbelow be referred to as a first embodiment of the present invention, and the latter method will be referred to as a second embodiment of the present invention.

FIRST EMBODIMENT

The first embodiment of the present invention as defined above will be described in detail first.

Figure 2A:
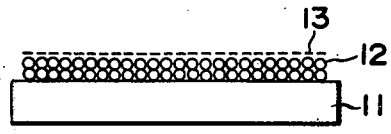
FIGS. 2A to 2D are side views showing the process of electrophotographic print marking employed in the first embodiment of the method in accordance with the present invention.

Referring to FIG. 2A, a photoconductive powder layer of photoconductive powder charged in negative polarity is formed on a surface of a steel plate from which rust has been removed. The photoconductive powder layer is formed in the dark. The steel plate may be replaced by a proper material having a properly conductive surface to be processed. The reference numeral 11 indicates the substrate such as a steel plate on which the photoconductive powder 12 is applied in a layer. The reference numeral 13 indicates the negative polarity in which the photoconductive powder 12 is charged. The polarity is determined by the properties of the photoconductive powder. For instance, in case of a photoconductive powder utilizing zinc oxide, charging in the negative polarity is preferable.

Figure 2B:
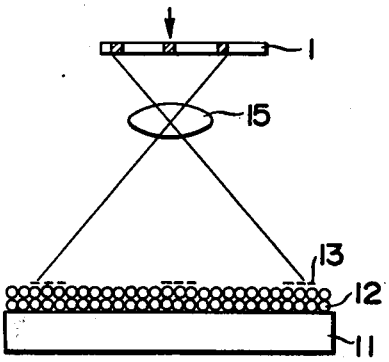

Then, as shown in FIG. 2B, the image of the original 1 is projected on the photoconductive powder layer 12 on the plate 11 to be processed by an optical system 15. In this projection step, the original 1 is projected by using light which transmits through the non-coating information 3, 4 and 5 but does not transmit through the marking information 2 and 6 to 10.

Figure 2C:
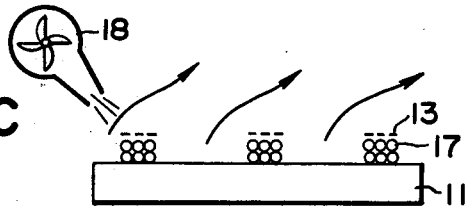
Figure 2D:
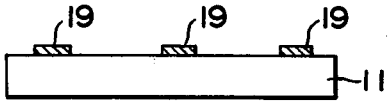

The charges in the exposed area of the photoconductive powder layer 12 are discharged and the potential is lowered to a great extent. On the other hand, the charges in the non-exposed area corresponding to the marking information are not discharged, and accordingly, an electrostatic latent image is formed on the photoconductive powder layer 12. The photoconductive powder charged is attracted by the surface of the plate 11. Consequently, by removing the powder the charge of which has been discharged by an air blow means 18 as shown in FIG. 2C, marking line images 17 are obtained. By heat fusing the marking line images 17 of powder on the plate 11 or by dissolving them with a solvent, stable marking lines 19 are obtained on the plate 11 as shown in FIG. 2D.

Figure 3A:
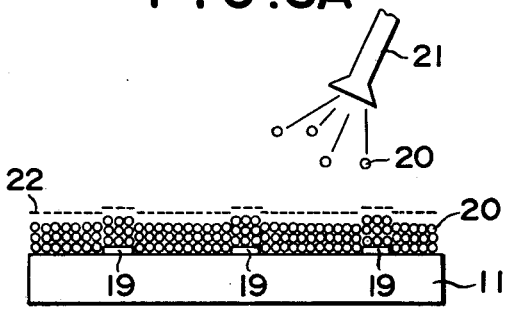
FIGS. 3A to 3C are side and perspective views showing the process of electrostatic powder coating in the first embodiment of the method in accordance with the present invention.

Thereafter, the surface of the plate 11 bearing the marking lines 19 is uniformly coated with electrostatic coating powder as shown in FIG. 3A. The coating powder 20 is applied on the plate 11 by use of a spray gun 21 for scattering the powder. The polarity 22 of the coating powder 20 is negative in this embodiment although it is not limited to the negative polarity as is well known in the art.

Then, the coating powder 20 on the plate 11 is selectively removed from the surface of the plate in a pattern form as disclosed in the specification of Japanese patent application No. 68481/1973. In order to remove the coating powder selectively, an air blow method or an air suction method can be employed.

Figure 3B:
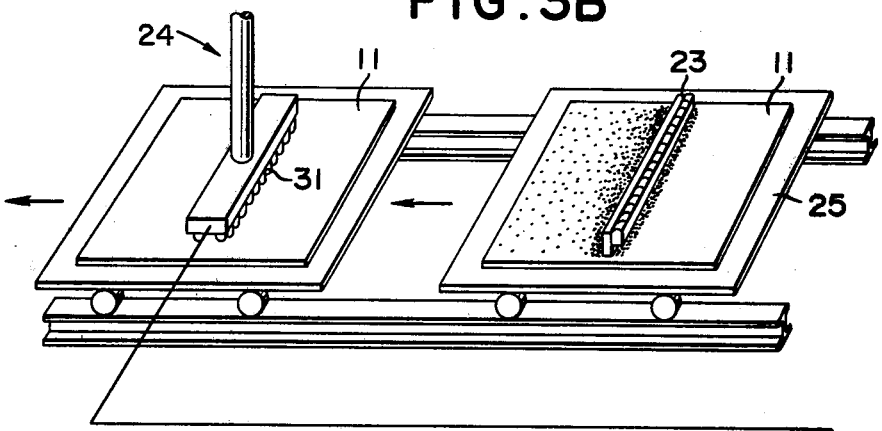
Figure 3C:
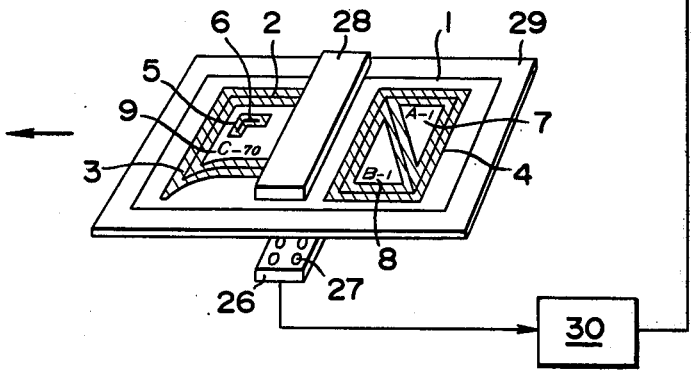

FIGS. 3B and 3C show the method of selectively removing the coating powder from the surface of the plate, FIG. 3B showing an example of the driving portion for applying and removing the coating powder, and FIG. 3C showing an example of a signal detecting portion.

As shown on the right in FIG. 3B, the plate 11 is carried on a carrying board 25 in the horizontal direction and the surface of the plate 11 is applied with coating powder by an electrostatic powder coating means 23. This process is the same as that shown in FIG. 3A.

Then, as shown on the left in FIG. 3B, the coating powder is removed selectively in a pattern form when the plate 11 is carried and moved horizontally under a powder removing means 24. The powder removing means 24 is provided with air nozzles 31 which blow or suck the air when the plate 11 bearing the coating powder is passed thereunder to blow off or suck in the powder thereon. Each nozzle is provided with a valve to close or open the nozzle so that the nozzles 31 are selectively operated to selectively remove the coating powder on the plate 11. The valves are operated in accordance with controlling signals transmitted from an original information read out device.

One example of the information read out device which reads out information carried on the optical original 1 is shown in FIG. 3C. The original 1 is placed on a board 29 which is optically transparent or half transparent. The board 29 is moved in the direction indicated by the arrow in FIG. 3C in synchronization with the movement of said carrying board 25. That is, if the reduction ratio in size of the original is 1/X where X is a positive number, the board 29 is moved at a speed of 1/X of the speed of the carrying board 25.

As shown in FIG. 3C, the original 1 placed on the board 29 is moved horizontally between a light source 28 and a photodetecting means 26 provided with a number of photodetectors 27. The number of the photodetectors 27 is the same as that of the nozzles 31 and the arrangement of the former corresponds to that of the latter. The space between adjacent photodetectors 27 is 1/X of the space between the adjacent nozzles 31. The photodetecting means 26 reads out the non-coating information 3, 4 and 5 carried by the original 1 and the read out signal is transmitted to an amplifier 30 connected with the photodetecting means. The signal amplified through the amplifier 30 is transmitted to said powder removing means 24.

By fixing the powder remaining on the plate 11, the coating can be applied on the plate 11 in the pattern form in accordance with the information from the original 1.

Now some of the steps in the above described process in accordance with the first embodiment of the present invention will be described in more detail.

a. Formation of the Photoconductive Powder Layer

The photoconductive powder layer 12 can be formed on the plate 11 by uniformly scattering the powder by use of a sift. Preferably, however, the photoconductive powder should be applied to the plate 11 by use of a specially designed device which simultaneously scatters the powder on the plate 11 and charges the powder. The powder should preferably be uniformly scattered on the plate 11. The amount of the powder to be applied to the plate should be determined to gain maximum advantage from the characteristics of the photoconductive powder. The relation between the amount of the photoconductive powder and the characteristics thereof is described in detail in the report of Applied Physics Supplement 3, Electrophotography (1969) pages 124 to 128. The particles of photoconductive powder used in the report have a diameter of 30 to 100 microns and a specific gravity of 1.5. In this report, the appropriate amount of scattering is said to be 50 to 150g/m$^2$.

b. Charging

The charging can be performed simultaneously with the scattering of the powder or after the scattering. A corona charger is used to uniformly charge the powder scattered on the plate. From the viewpoint of the efficiency in charging the powder measured per a unit area, the former process in which the powder is charged simultaneously with the scattering thereof is much superior to the latter process in which the powder is charged after it is scattered on the plate.

c. Exposure

The exposure can be performed by a normal projection of the image by use of a projection optical system. If the material of the original is suitable for the contact printing, the imagewise exposure of the photoconductive powder layer is performed by contact printing.

d. Development

In this step, the powder on the plate in the exposed area is removed after the exposure, by air blow and/or vibration of the plate.

e. Electrostatic Coating

Coating powder is applied on the plate partially bearing the photoconductive powder by a proper electrostatic coating device. The thickness of the layer of coating powder is determined in accordance with the purpose of the coated plate. In normal powder coating, the coating is usually formed in a large thickness since it is a prominent advantage of electrostatic coating that the coating can be made in large thickness. Usually, therefore, the thickness of the coating is 100 to 200 microns after it is heated and fixed. The coating is performed by use of a single or a plurality of spray guns, and charging is performed at a high voltage of about 60 to 90KV.

f. Removal of the Coating Powder in Pattern Form and Read Out of Information of the Original The device for removing the coating powder from the plate consists of one or a plurality of nozzles. When only one nozzle is used, the nozzle must be moved in a two-dimensional plane. In this case, the detecting element for reading out the information of the original also moves on the original in a two-dimensional plane. The read out element and the nozzle must be moved in exact correspondence to each other.

One example of the device with a plurality of nozzles will now be described in detail with reference to the drawing. In FIG. 3B, the powder removing means 24 is provided with two lines of suction nozzles 31 arranged to have overlapped suction areas on the plate 11. Each nozzle is provided with a control valve for controlling the rate of the air flow sucked therethrough. The valves of the nozzles are operated independently of each other by electric signals. When the valve of a nozzle is opened, the powder under the nozzle is sucked through the nozzle and removed from the surface of the plate 11. By controlling the valves in time series, the powder on the plate can be removed in a pattern form to form an imagewise powder coating on the plate.

When the nozzles 31 are controlled to selectively remove the powder on the plate, the nozzles are desirably moved all together in synchronization with the photodetectors which are also moved all together. It will be understood that the original and the plate can be moved instead of moving the photodetectors and the nozzles. As for the photodetectors, photosemiconductors such as silicon photosensitive elements or cadmium sulfide elements are used. These photodetectors 27 must be sensitive to length at least in the range of the wave lengths of the light indicating the no coat area information.

g. Original

The original 1 is a transparent or half-transparent film in which the marking information and the non-coating information are provided in different colors.

In FIG. 1, the marking information 2 and 6 to 10 is recorded on the film with a color which is opaque to the light to which the photoconductive powder 12 shown in FIG. 2A is sensitive. The width of the lines indicating the marking information is 0.5 to 4mm in the image projected on the plate 11. Therefore, in the original image the reduction ratio of which is 1/10, the width of the lines is 0.05 to 0.4mm. The non-coating information indicated by the hatched areas 3, 4, and 5 should be distinguished from the marking information indicated by the lines. The color of the non-coating information is therefore to be opaque to the light to which the photodetectors 27 are sensitive. Further, the color of the non-coating information must be transparent to at least a part of the light to which the photoconductive powder 12 is sensitive so that the photoconductive powder 12 may be exposed to the light passing through the area of the non-coating information.

The width of the no coat area is 20 to 300mm on the plate 11 to be processed. Therefore, the width of the non-coating information area in the original 1 the reduction ratio of which is 1/10 is 2 to 30mm. It is not necessary to provide a non-coating information area around the marking information in the case of the character information 7 to 9.

It will be understood from the above description that the marking information and the non-coating information are only required to be opaque to the light which is used in the step of the marking process and the coating process, respectively. Therefore, various combinations of the color of the information area and the range of wavelength of the light to which the photoconductive powder is sensitive are practically possible.

Now assuming that the wavelength region is divided into three regions, A, B, C, and a light source which emits light of the wavelength covering all the three regions A, B, and C is used, and the region of the wavelength of the light to which the photoconductive powder 12 is sensitive is B, the marking information 2 and 6 to 9 is required to be recorded in the color which is opaque to the light of the wavelength in the region B. For instance, if B is green, red, Magenta or black can be used for the marking information. If B is red, cyan, blue or black can be used for the marking information.

On the other hand, the non-coating information on the original 1 must be in the color which is transparent to the light of the color in the region of B. For instance, if B is green, yellow, green or cyan can be used for the non-coating information. If B is red, red, yellow, orange or Magenta can be used.

The range of the wavelength of the light to which the photodetectors 27 are sensitive must be in the range of the wavelength of the light to which the non-coating information area 3 to 5 on the original 1 is opaque. For instance, if the color of the non-coating information area 3 to 5 is green, blue or red; if it is yellow, if it is cyan, red; if it is red, greenish blue or bluish green; if it is orange, blue or bluish green; and it is cyan, red can be used for the non-coating information area 3 to 5 in the original 1.

The above selection of colors can be represented as in Table I.

TABLE I

| (1) | (2) | (3) | (4) |
|---|---|---|---|
| B | $\bar{B}$, or $\bar{B}$ and $\bar{C}$, or $\bar{B}$ and $\bar{A}$, or $\bar{A}$ and $\bar{B}$ and $\bar{C}$ | B and $\bar{A}$ and C<br>B and $\bar{C}$ and $\bar{A}$<br>B and $\bar{C}$ and $\bar{A}$ | A<br>C<br>A or C, or A and C |
| A and B | $\bar{A}$ and $\bar{B}$, or $\bar{A}$ and $\bar{B}$ and $\bar{C}$ | A and B and $\bar{C}$, or A and $\bar{C}$, or B and C | C |
| A and B and C | $\bar{A}$ and $\bar{B}$ and $\bar{C}$ | A and $\bar{B}$ and $\bar{C}$<br>$\bar{A}$ and B and C<br>A and B and C | C<br>B<br>A |

The regions A, B and C may be somewhat overlapped with each other. Essentially, it is only required that the photoconductive powder and the photodetectors are sufficiently sensitive to the marking information and the non-coating information, respectively.

When the light source used here contains only a part of the light in the regions of A, B and C, respectively, or contains light of the wavelength extending all over the regions A, B and C, and filters are used together with the light source,the photoconductive powder and the photodetectors are desired to be sensitive to light of the wavelength extending over more than one region. For instance, when the photoconductive powder and the photodetectors are sensitive to light of the wavelength in the regions of A and B, the marking lines are recorded in black and the non-coating area is recorded in the color of A and a filter which passes the light of A is used in the marking process to filter the light in the projection optical system. In the coating process, a filter which passes the light of B is used to filter the light in the projection optical system. The light source may, therefore, be a white light source such as an incandescent lamp. Further, it will be understood that the photoconductive powder and the photodetectors may be of types that are sensitive to all three colors A, B and C. The light is not limited to visible light, but may be ultra violet or near infra-red ray.

Although the above description has been made with particular reference to an embodiment wherein the non-coating information area on the original is colored to be opaque to light of a predetermined wavelength, it is possible to make the non-coating information area transparent to light of a predetermined wavelength. In such a case, the color indicated in (3) in Table I as "color of the non-coating information on the original" is to be read as "color of coating area information on the original".

Further, when a photosensitive emulsion is applied to the plate and the exposed area of the plate with the emulsion layer is to be made opaque, it is possible to use an original which has transparent or half transparent marking lines surrounded by non-coating information area of a color which passes only the light of a predetermined wavelength. The non-coating information area is further surrounded by opaque area.

Now, the photoconductive powder, the plate to be processed, the coating powder and the photodetectors will be described in more detail particularly with respect to the material to be used therefor.

a. Photoconductive Powder

The photoconductive powder preferably has the characteristic of being able to maintain a potential for a long time in the dark (1 to 10 minutes) and of being quickly lowered in potential by exposure. The structure of and the method of making the photoconductive powder used for this purpose are disclosed in the following patent specifications.

British Pat. No. 1183762, British Patent 120071, French Pat. No. 1536725, and Japanese patent publication No. 12385/1969. The structure of the photoconductive powder disclosed in these patents can be expressed generally as a particle consisting of a transparent center core covered with a thin photoconductive surface layer. As for the surface layer of the photoconductive material, there are used not only zinc oxide-resin binder but also resin binder and photoconductive powder such as Cds, $Tio_2$ and phthalocyanine series pigments or organic photoconductors such as polyvinylcarbazole, indoline derivatives and anthracene. Transparent particles of photoconductive material such as organic photoconductors or phthalocyanine series pigments dispersed in a resinous binder can also be used here.

The spectroscopic sensitivity of these photoconductive materials can be controlled by well known methods, for instance, by making the photoconductive pigments or the powder adsorb coloring matter. Besides the above described photoconductors, any other material can be used therefor if it has sufficient photoconductivity. As a commercially available photoconductor suitable for the photoconductive powder is known "EPM Photoner No. 327" made by Fuji Photo Film Co., Ltd., the diameter of the powder of which is generally 20 to 150 microns.

Further, the photoconductive powder may be sensitized by a sensitizing coloring matter or pigments such as fluorescein, Rose bengale, phthalocyanine blue, triphenylmethane, brilliant blue, cadmium red, cadmium orange, phthalocyanine green, brilliant carmine etc.

b. Plate to be Processed (Surface on which the photoconductive powder is scattered).

The plate to be processed may be made of any material if the surface thereof has proper conductivity and does not present strong adhesiveness. The conductivity is preferably not less than $10^{-1}\Omega$. Metal plates, paper processed to have conductivity and steel plates having a coating which is processed to have a conductive surface are examples of preferable plates to be used here.

c. Coating Powder to be Electrostatically Applied

The coating powder is required to be non-conductive and to be capable of holding electrostatic charges for a certain period. As the coating powder there is usually used so-called "powder coating material", which is made by first mixing pigments with a resin which is melted at a proper temperature and forms a continuous film and then making the resin containing the pigments into particles of the diameter of 20 to 150 microns. As for the resins which can be used, thermoplastic resins such as polyvinyl chloride, vinyl chloride vinyl acetate copolymer, vinyl chloride acrylonitrile copolymer, acrylic ester acrylonitrile copolymer, acrylic ester styrene copolymer, methacrylic ester acrylonitrile copolymer, methacrylic ester styrene copolymer, polyamide resin, nitrocellulose polyamide resin, cellulose diacetate, cellulose triacetate, cellulose propionate, cellulose acetate butylate, nitrocellulose, styrene butadiene copolymer, and polyester resin; and thermo-setting or reaction type resins such as the mixtures of isocyanate prepolymer and epoxide resin, alkyd resin, silicone resin, phenol resin or high molecular weight polyester resin.

d. Photodetector

Any type of generally used photodetectors can be used. For instance, silicon, germanium, or silicon or germanium containing nitrogen or phosphorus as foreign materials can be used. Sulfides of cadmium, lead and zinc, selenides of the same and tellurides of the same can also be used. Further, semiconductors such as Se, GaAs, GaP, InP, $Tl_2S$, InSb, AlSb, SiC, $Sb_2S_3$ etc. and $Cu_2O$, ZnO and PbO can be used. Organic photoconductors such as polyvinylcarbazole can also serve as the photodetector used here.

Figure 4A:
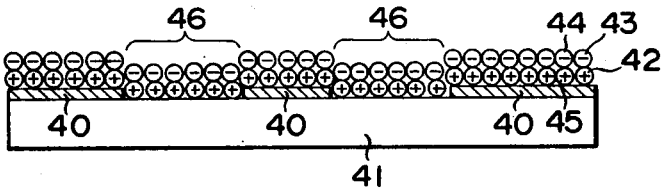
FIGS. 4A to 4C are side views showing the process of electrophotographic print marking employed in the second embodiment of the method in accordance with the present invention.

Now referring to FIGS. 4A to 4C, the second embodiment of the present invention will be described in detail. In FIG. 4A, coating layer parts 40 are formed on the surface of a plate 41 to be processed. The parts 40 are formed in a pattern form on the plate 41. The coating layer is formed thereon by the same method as that employed in the first embodiment shown in FIGS. 3A to 3C. The no coat area is indicated by 46 in FIG. 4A. After the pattern formed coating layer 40 is formed on the plate 41, positively charged photoconductive powder 42 is scattered uniformly over the surface of the plate 41. Further, on the photoconductive powder layer 42 is uniformly applied a layer of negatively charged photoconductive powder to form a double layer of photoconductive powder. It is also possible to scatter the negatively charged powder first, and then scatter the positively charged powder thereon. The photoconductive powder 42 may be of the same material as the other photoconductive powder 43, or different therefrom. The reference numerals 44 and 45 indicate the polarity in which the photoconductive powder 42 and 43 is charged. The scattering of the photoconductive powder must be conducted in the dark as mentioned in the description of the first embodiment.

Figure 4B:
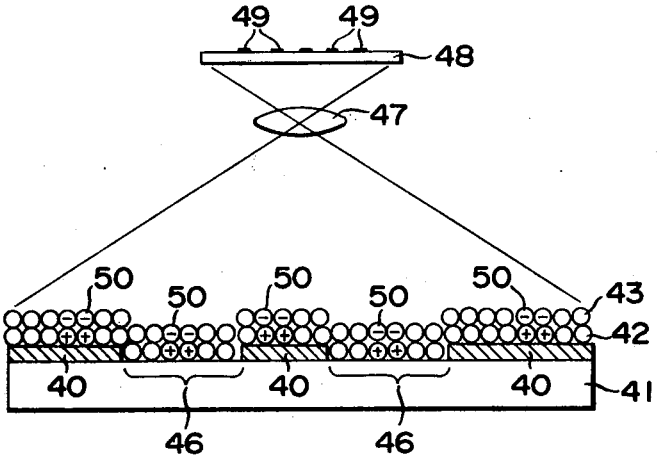

Then, as shown in FIG. 4B, the photoconductive double layer is exposed to imagewise light through a projection optical system 47 which projects the image of an original 48 onto the surface of the double layer of the photoconductive powder 42 and 43. The original 48 carries marking information 49. By the imagewise exposure, the areas 50 which correspond to the marking information 49 on the original 48 are not exposed and the charges therein are not discharged accordingly. In the residual parts of the photoconductive layers surrounding the exposed areas 50, the charges are all discharged. The color and the spectral sensitivity of the photoconductive powder are determined in the same manner as employed in the first embodiment.

Figure 4C:
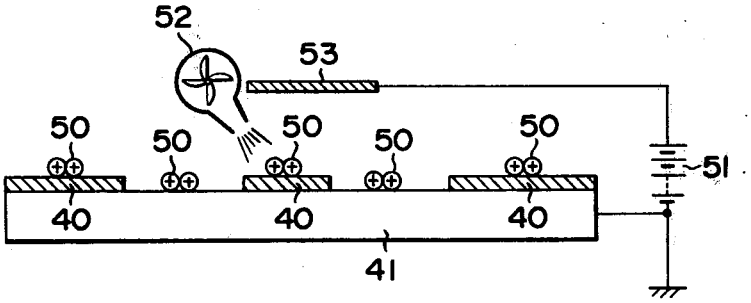

Thereafter, as shown in FIG. 4C, the photoconductive powder on the plate 41 is removed by air blow or the like while impressing a bias voltage on the surface of the plate by use of a D.C. power 51 and a bias impressing electrode 53. The reference character 52 indicates a blower for applying air blow on the surface of the plate. Only the photoconductive powder 50 which is charged to be attracted by the plate 41 is left on the plate 41 and the remainder is blown off and removed therefrom by the air blow. Thus, a powder image is obtained on the surface of the plate 41.

By performing the operation described above, the photoconductive powder is applied imagewise on the surface of the plate which surface consists of the surface of the coating layer 40 presenting a surface resistance of not less than $10^{10}\Omega$ and the surface of the non-coated area of the plate 41 presenting the surface resistance of not more than $10^{10}\Omega$. Thereafter, the photoconductive powder 50 is fixed to the surface by use of solvent or heat to obtain a fixed marking line image.

The electrophotographic print marking process for forming the marking lines on a plate will hereinbelow be described in detail.

a. Formation of the Charged Photoconductive Powder Layer

Differently from the first embodiment, in the second embodiment the photoconductive powder must be charged before or simultaneously with the scattering thereof. This is because it is undesirable to charge the surface of the plate since the balance in charge over the surface of the plate is lost if the surface of the coating layer is charged. Further, the amount of positive charge and that of negative charge are preferably equal to each other.

b. Exposure

The step of exposure of the photoconductive layer to the imagewise light is the same as the exposure step in the first embodiment.

c. Development

The development is conducted with a bias voltage being impressed on the plate. The bias voltage is usually 10V/cm to 1KV/cm. Similarly to the first embodiment, the development is performed by use of air blow and/or vibration of the plate.

d. Original

The original which carries the image to be projected on the plate is the same as that used in the first embodiment.

In accordance with the second embodiment as described hereinabove, marking lines can be recorded on the coating layer. Therefore, the second embodiment is particularly suitable in treating information which includes character information as shown by 7 to 9 in FIG. 1 which are to be recorded on the coating layer. In both embodiments, the original carries two kinds of information which are indicated in different colors. The different information may be separately recorded on the original or overlapped with each other.

In order to read out the information carried on the original, the following two methods can be employed. One is to detect the light passing through the original and the other is to detect the light reflected by the original. In the former method, the original must be transparent or at least half transparent, and in the latter method the original may be transparent, half transparent or opaque. The principle of detection is the same in the both methods.

When the original which carries the two kinds of information represented by different colors is illuminated by light of one color, the light is reflected by or transmits through a part of the original of one color which represents one kind of information. When the original is illuminated by light of another color the light is reflected by or transmits through another part of the original of the other color which represents the other kind of information. Therefore, by using a photodetector which is sensitive to light of both of said different colors and making the light of the different colors impinge on the photodetector independently, the two kinds of information can be independently detected. In order to make the light of different colors impinge on the photodetector independently, a color filter is used or different light sources of different colors are used as is well known in the art.

Figure 5A:
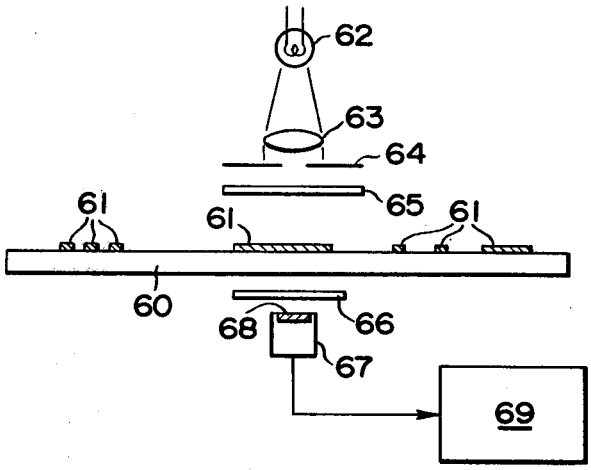
FIGS. 5A and 5B are side views showing the photodetecting means for detecting information employed in the present invention.
Figure 5B:
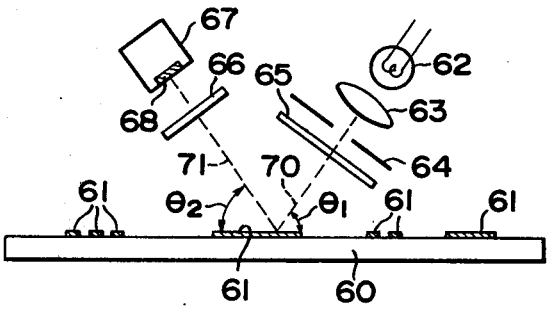

FIGS. 5A and 5B show the information read-out device which can be used in this invention as described above. The device shown in FIG. 5A is of the transmission type and the device shown in FIG. 5B is of the reflection type as is apparent from the drawing.

Referring to FIG. 5A, an original 60 which carries information 61 on a transparent substrate is horizontally moved between a projection optical system and a detecting device 67. The projection optical system comprises a light source 62, a collimating lens 63, an optical slit 64 and a filter 65. The detecting device 67 is provided with a photodetector 68. Another filter 66 is located between the original 60 and the detecting device 67. An amplifier 69 is connected with the detecting device 67 to amplify the output of the detecting device 67. It will be understood that the filters 65 and 66 are used for selecting the range of wavelength of the light passing through the original and impinging on the photodetector 68. Further, it will be understood that the filters 65 and 66 can be eliminated if the light source 62 can be changed to obtain different color of light. A convergent lens can be located on the photodetector 68 to increase the intensity of light impinging on the photodetector 68. The slit 64 may be located in front of the detecting device 67 instead of being located above the original 60.

Referring to FIG. 5B which shows an information read-out device of the reflection type, all the elements corresponding to those shown in FIG. 5A are indicated with the same numerals as those used in FIG. 5A. The positions of the light source 62 and the detecting device 67 are determined so that the angles $\theta_1$ formed between the incident light and the surface of the plate 60 and $\theta_2$ formed between the reflected light and the surface of the plate 60 are equal to each other. Similarly to the read out device as shown in FIG. 5A, the filters 65 and 66 can be removed and a convergent lens can be located in front of the photodetector 68. The sectional area of the slit 64 should preferably be equal to the unit area of the unit information so that the information may be detected efficiently by the photodetector with as small noise as possible. However, if the slit is designed to have an extremely large area with respect to the area of the marking lines, there is an advantage that it becomes possible to detect the non-coating information without eliminating the marking information. That is, if the area of the slit is 3 to 70 times as large as the area of the marking lines covered by the slit, the marking information can be treated as noise since the output corresponding to the marking information contained in the output of the non-coating information is negligibly small in comparison with the latter. The width of the marking lines is usually 1/10 to 1/200 as small as the width of the no coat area. By utilizing the above described phenomenon whereby the marking information can be treated as noise in the detection of the non-coating information, more freedom can be had in the choice of the colors for the two kinds of information. Further, another method for gaining greater freedom in the choice of the colors for carrying the information is to lower the sensitivity of the photodetector. By lowering the sensitivity of the photodetector, the marking information can be treated as noise which does not generate a signal to operate a valve for controlling the air blow or air suction.

As will be apparent to those skilled in the art from the above description, the information can be presented by black and gray. In this case, the residual part of the original is made colorless and transparent, the marking line information is made black and the non-coating information is made gray. The sensitivity of the photodetector for detecting the marking information and that for detecting the non-coating information are made different so as to independently detect the two kinds of information.

Now several examples of the method in accordance with the present invention will be described in detail. It will be understood that the present invention is not limited to the particular examples hereinbelow described. The "part" indicated in the data of the examples means weight part.

EXAMPLE I

The original was made of polyester film which carried marking line information recorded in black and a non-coating information recorded in yellow. The photoconductive powder had a composition as follows.

| | |
|---|---|
| photoconductive zinc oxide having adsorbed coloring agent | 150 parts |
| silicone resin varnish (made by Fuji Polymer Industry Co., Ltd.) | 40 parts |
| cyclohexane | 100 parts |

The above substances were mixed in a ball mill and 20 parts of the mixture was added to 70 parts of polymethyl methacrylate resin powder of an average particle size of 70$\mu$ (the absorption coefficient for the radiation of the wavelength of 3800A in the region of the specific sensitivity of the zinc oxide was 25mm$^{-1}$). The mixture was stirred and dried to obtain photoconductive powder covered with a photoconductive surface layer.

One part of fluorescein and one part of Rose bengal were used as the adsorption coloring agent for 1000 parts of zinc oxide. The photoconductive powder was sensitive to near ultra-violet light, blue light and green light. The color of the photoconductive powder was white gray.

The powder was scattered on a steel plate at a rate of 80g/m$^2$. Charging of the powder was performed simultaneously with scattering. The image of the original was projected on the steel plate by use of a xenon lamp light source. When the powder thereon was blown off, marking lines appeared. The powder marking lines were fixed by a sprayed solvent of dimethyl-ethane. Then, polyamide type coating powder ("Evaron 5000" made by Chugoku Marine Paints Ltd.) was scattered on the plate by an electrostatic powder coating machine made by Lansberg Co. in the thickness of 300 to 500$\mu$. The air pressure was 5Kg/cm$^2$ and the charging voltage was −70KV. The thickness of the fixed coating was finally made 200$\mu$.

Then, the same original was used to detect the non-coating information. The detection was performed by use of silicon photocells ("BP55A" made by Matsushita Electric Ind. Co., Ltd.) with a blue filter located between the light source and the detectors. The removal of the coating powder in the pattern form was conducted by use of air suction. The suction pressure was 2000mmHg and the diameter of the suction nozzles was 15mm and the distance between the top of the nozzles and the surface of the plate was 2.5mm. The nozzles were 30 in number and arranged in two lines. The plate was passed under the nozzles at a speed of 6m/min. Consequently, a very sharp pattern like coating was obtained on the plate. Then, the coating powder on the plate was fixed by heat of 230° C for 20 minutes.

EXAMPLE II

An original which had black marking line information and red non-coating information was used. The photoconductive powder used was the same as that used in Example I except that 2 parts of food color blue No. 1 was added to 100 parts of zinc oxide as a sensitizing coloring matter. The photoconductive powder was sensitive to ultra-violet light and red light. The marking process was conducted by the same method as that employed in Example I, and marking lines were obtained on the plate. Then, by the same method as that employed in Example I, coating powder was applied uniformly on the plate. The thickness of the coating powder applied on the plate was 300 to 500μ. Similarly to Example I, the coating powder was removed in a pattern form by use of air suction. The non-coating information was detected by use of the same photodetectors as those employed in Example I. Then, the powder remaining on the plate was fixed by heat of 230° C for 15 minutes.

EXAMPLE III

The original used was the same as that used in Example I. Quite the same coating powder as used in Example I was applied on the plate by the same method as that employed in Example I. Then, the powder was removed in a pattern form by air suction. Through a blue filter, the non-coating information carried by the original was read out by silicon photodiodes. Thereafter, the powder on the plate was fixed by heat of 250° C. The same photoconductive powder as used in Example I was negatively charged and scattered on the plate. The surface potential was 250V and the amount of powder scattered on the plate was 70g/m$^2$. Then, photoconductive powder charged positive was scattered on the plate. The surface potential became zero. The amount of powder scattered was 70g/m$^2$. Since photoconductive powder is more sensitive when charged negative than when charged positive, the layer of negatively charged powder was applied beneath the positively charged powder layer. After the exposure of the powder layer to the imagewise light obtained through the original, the powder was selectively removed in pattern form by air blow. As the powder was being removed by air blow, a bias voltage of 500V/cm was impressed on the plate. The rate of the air blow was set to be 15 to 25m/sec. Thus, sharp marking lines were obtained.

EXAMPLE IV

The original and the photoconductive powder used were the same as those used in Example II. The coating powder was applied on the plate in accordance with the second embodiment of the invention.

The photoconductive powder as used in Example II was uniformly applied on the plate. The thickness of the coating was about 200μ. A Lansberg's electrostatic powder coating machine was used. Then, the coating powder on the plate was removed in a pattern form. The non-coating information was detected by use of silicon photodiodes. The powder remaining on the plate in a pattern form was fixed by heat of 220° C. Then, photoconductive powder charged negative was scattered on the plate at the rate of 70g/m$^2$. The surface potential was 300V. Then, photoconductive powder charged positive was scattered on the plate. The surface potential became zero. After the original was exposed to imagewise light, the powder was selectively removed by air blow the rate of which was 15 to 25m/sec on the surface of the plate. As the powder was being removed, a bias voltage of 600V/cm was impressed on the plate. Thus, sharp marking lines were obtained on the plate. The developed marking lines were fixed on the plate by spraying dimethyl ethane thereon.

EXAMPLE V

The mixture of the following substances were mixed in a ball mill for 20 hours.

| | |
|---|---|
| cadmium yellow orange | 150 parts |
| epicoat ester varnish | 48 parts |
| epoxy ester (hydrated caster oil fatty ester, oil length: 40% non-volatile matter: 50%) | |
| Silicone resin KR-211 (made by Sinetsu Chemical Co., Ltd.) | 23 parts |
| toluene | 60 parts |

80g of the above mixture was added to 200g of glass beads and stirred. The minimum diameter of the glass beads was 40μ and the maximum diameter was 117μ. The absorption coefficient for the radiation of the wavelength of 5500A in the region of the specific sensitivity of the cadmium yellow orange of the glass beads was 1mm$^{-1}$. After the mixture was stirred and dried, the mixture was grounded to powder in a mortar and used as the photoconductive powder.

Then, the powder was applied on the plate and a patterened coating was performed in accordance with the same method as that employed in Examples I and III. Consequently, a steel plate bearing yellow marking line information and pattern-like non-coating information was obtained.

The present invention is particularly effective and useful when employed in a metal processing system in which a metal sheet is applied with a primary coating for rust proofing and marking lines are provided thereon automatically.

In accordance with the present invention, it is possible to form a coating of the thickness of several hundreds of microns at a time, whereas in the conventional method the thickness of the coating which could be applied at a time has been only several tens of microns. Therefore, in combination with the electrophotographic print marking method, the number of processes for coating a plate is markedly reduced in accordance with the present invention.

I claim:

1. A method of selectively applying electrostatic coating powder to a plate in a pattern to form an uncoated area on the plate on the surface of which marking lines are to be printed by an electrophotographic print marking process comprising the steps of, providing an optical original having recorded thereon both marking information in a linear form and non-coating information in a form corresponding to areas on a plate to remain uncoated with the electrostatic coating powder, said marking information and said non-coating information on said optical original having different spectral transmittance or reflectance, electrophotographically printing on the plate marking lines corresponding to said marking information using said optical original comprising the steps of uniformly applying photoconductive powder on the plate, uniformly charging the photoconductive powder applied on the plate, exposing portions of the charged photoconductive powder on the plate to imagewise light in accordance with the marking information on said optical original to neutralize the charge of the exposed portions of the photoconductive powder on the plate, and removing the exposed portions of the photoconductive powder from the plate, the charge of which has been neutralized, from the surface of the plate, and fixing the unexposed portions of the photoconductive powder, uniformly applying a layer of electrostatically charged coating powder on the plate, detecting the non-coating information on said optical original with photodetecting means to provide an output signal, selectively removing portions of said layer of coating powder from the plate by air flow by controlling a powder removal means with the output signal of the photo detecting means to form said uncoated areas on the plate corresponding to the non-coating information carried by the optical original and fixing the remaining portions of the layer of coating powder on the plate to the surface thereof.

2. Method of selectively applying coating powder on a plate as defined in claim 1 wherein the step of preparing a layer of charged coating powder on the plate comprises a step of simultaneously charging the coating powder and scattering the charged powder on the plate uniformly.

3. Method of selectively applying coating powder on a plate as defined in claim 1 wherein the step of preparing a layer of charged coating powder on the plate comprising the steps of uniformly scattering the coating powder on the plate and then uniformly charging the coating powder on the plate.

4. Method of selectively applying coating powder on a plate as defined in claim 1 wherein the area of said marking information recorded on the optical original is much smaller than the area of said non-coating information to such a degree that the output of the photodetecting means representing the marking information is negligibly small in comparison with the output thereof representing the non-coating information when the non-coating information is detected, whereby the two kinds of information are detected independently of each other.

5. Method of selectively applying coating powder on a plate as defined in claim 4 wherein the width of the non-coating information recorded on the optical original is ten to one hundred times as large as that of the marking information recorded on the optical original.

6. Method of selectively applying coating powder on a plate as defined in claim 1 wherein said photodetecting means comprises a plurality of photodetectors which are sensitive to both the light transmitted through or reflected by said marking information and to the light transmitted through or reflected by said non-coating information.

7. Method of selectively applying coating powder on a plate as defined in claim 6 wherein said photodetecting means has a unit detecting area which is 3 to 70 times as large as the area occupied by the marking information covered by one photodetector.

8. Method of selectively applying coating powder on a plate as defined in claim 6 wherein the step of selectively removing the coating powder comprises the step of sucking in the powder on the plate by use of air sucking means which is controlled by the output of said photodetecting means.

9. Method of selectively applying coating powder on a plate as defined in claim 8 wherein said air sucking means comprises a plurality of air suction nozzles of the same number as that of the photodetectors, said air suction nozzles being arranged in the same arrangement as that of the photodetectors.

10. Method of selectively applying coating powder on a plate as defined in claim 6 wherein the step of selectively removing the coating powder comprises the step of blowing away the powder on the plate by use of air blowing means which is controlled by the output of said photodetecting means.

11. Method of selectively applying coating powder on a plate as defined in claim 10 wherein said air blowing means comprises a plurality of air blow nozzles of the same number as that of the photodetectors, said air blow nozzles being arranged in the same arrangement as that of the photodetectors.

* * * * *